United States Patent [19]

Ishizuka et al.

[11] Patent Number: 4,549,855

[45] Date of Patent: Oct. 29, 1985

[54] COMPRESSION CAPACITY CONTROL APPARATUS FOR SWASH PLATE COMPRESSOR

[75] Inventors: Yutaka Ishizuka; Tsunenori Shibuya, both of Saitama, Japan

[73] Assignee: Diesel Kiki Company, Ltd., Tokyo, Japan

[21] Appl. No.: 698,295

[22] Filed: Feb. 5, 1985

Related U.S. Application Data

[62] Division of Ser. No. 413,642, Sep. 1, 1982, Pat. No. 4,511,313.

[30] Foreign Application Priority Data

Sep. 11, 1981 [JP] Japan ..... 56-143525

[51] Int. Cl.[4] ..... F04B 1/28; F04B 49/08

[52] U.S. Cl. ..... 417/270; 417/286; 417/304

[58] Field of Search ..... 417/269, 270, 288, 302, 417/304

[56] References Cited

U.S. PATENT DOCUMENTS 2,925,551 3/1960 Heidorn ..... 417/270
4,373,870 2/1983 Pandzik ..... 417/440

FOREIGN PATENT DOCUMENTS 708212 7/1931 France ..... 417/307
160187 12/1980 Japan ..... 417/270
146069 9/1982 Japan ..... 417/269

*Primary Examiner*—William L. Freeh
*Attorney, Agent, or Firm*—Jordan and Hamburg

[57] ABSTRACT

A swash plate compressor is disclosed which is provided with a compression capacity control apparatus capable of returning an output pressure of a high pressure chamber of one cover to a low pressure chamber of the same cover. The control apparatus comprises a delivery chamber which is communicated with a high pressure chamber of the other cover, isolated from the high pressure chamber of the one cover and connected to a delivery conduit. The control apparatus also comprises a compression capacity control passageway providing communication between the delivery chamber and the low pressure and high pressure chambers of the one cover. A rotary three-way valve member is disposed in the control passageway to interrupt the communication between the delivery chamber and the high pressure chamber of the one cover while establishing communication between the low pressure and high pressure chambers of the one cover. A relief valve is provided to communicate to the delivery chamber an elevated pressure in the compression chamber of the one cover while the rotary valve member shifts from one position to another.

2 Claims, 6 Drawing Figures

COMPRESSION CAPACITY CONTROL APPARATUS FOR SWASH PLATE COMPRESSOR

CROSS REFERENCE TO RELATED APPLICATION

This application is a division of copending U.S. patent application Ser. No. 413,642, filed Sept. 1, 1982 now U.S. Pat. No. 4,511,313.

BACKGROUND OF THE INVENTION

The present invention relates to a multi-cylinder swash plate compressor and, more particularly, to an apparatus capable of controlling such a compressor into a part-capacity operation mode, as distinguished from the usual full-capacity operation mode.

In a swash plate compressor with multiple cylinders, it is desirable, and possible, to render some of the cylinders ineffective to lower the compression capacity or output pressure in response to a decrease in load. A swash plate compressor usually includes low pressure and high pressure chambers for temporary storage of a gas which are formed in each of front and rear covers mounted on a cylinder block. It will therefore be easy to arrange the compressor such that a compressed gas discharged into the high pressure chamber in one of the covers is fed back into the lower pressure chamber, thereby halving the entire capacity of the compressor. However, since the high pressure chambers in both the front and rear covers are connected to a common delivery conduit and to each other, the gas from the high pressure chamber in one cover tends to be communicated back to the low pressure chamber of the other cover during a part-capacity operation mode of the compressor. An implement heretofore known for coping with such a tendency comprises a check valve which is located in the delivery passageway between the high pressure chambers in the opposite covers. The check valve prevents the high pressure gas from flowing in the reverse direction while the compressor is operated in the part-capacity mode. This is not acceptable because, in a full-capacity operation mode, the check valve creates resistance to the flow of the delivery pressure which results in significant falls of efficiency and frequent failures.

SUMMARY OF THE INVENTION

In a swash plate compressor having a cylinder block, front and rear covers mounted on the opposite ends of the cylinder block, each front and rear covers being formed with a low pressure chamber for temporarily storing an incoming gas, a high pressure chamber for temporarily storing an outgoing gas and a delivery conduit for delivering the outgoing gas; a compression capacity control apparatus embodying the present invention comprises a delivery chamber formed in one of the front and rear covers to be communicated with the high pressure chamber in the other cover, isolated from the high pressure chamber in the one cover and connected with the delivery conduit. A compression capacity control passageway provides communication between the delivery chamber and high pressure chamber in the one cover and communication between the high and low pressure chambers in the one cover. A rotary valve member is disposed in the control passageway and operable to block communication between the delivery chamber and the high pressure chamber of the one cover while unblocking the communication between the high pressure chamber and the low pressure chamber of the one cover. A relief valve is provided for communicating to the delivery chamber an elevated pressure in the compression chamber of the one cover while the valve member shifts from one position to another.

In accordance with the present invention, a swash plate compressor is provided with a compression capacity control apparatus capable of returning an output pressure of a high pressure chamber of one cover to a low pressure chamber of the same cover. The control apparatus comprises a delivery chamber which is communicated with a high pressure chamber of the other cover, isolated from the high pressure chamber of the one cover and connected to a delivery conduit. The control apparatus also comprises a compression capacity control passageway providing communication between the delivery chamber and the low pressure and high pressure chambers of the one cover. A rotary threeway valve member is disposed in the control passageway to interrupt the communication between the delivery chamber and the high pressure chamber of the one cover while establishing communication between the low pressure and high pressure chambers of the one cover.

It is an object of the present invention to provide a new compression capacity control apparatus for a swash plate compressor which eliminates all the drawbacks inherent in the prior art apparatus.

It is another object of the present invention to provide a new compression capacity control means for a swash plate compressor which permits the compressor to operate in a part-capacity mode with a minimum of power loss and without any sacrifice to the efficiency attainable with a full-capacity operation mode.

It is another object of the present invention to provide a generally improved compression capacity control apparatus for a swash plate compressor.

Other objects, together with the foregoing, are attained in the embodiments described in the following description and illustrated in the accompanying drawings.

DESCRIPTION OF THE PREFERRED EMBODIMENTS

While the compression capacity control apparatus for a swash plate compressor of the present invention is susceptible of numerous physical embodiments, depending upon the environment and requirements of use, substantial numbers of the herein shown and described embodiments have been made, tested and used, and all have performed in an eminently satisfactory manner.

Figure 1:
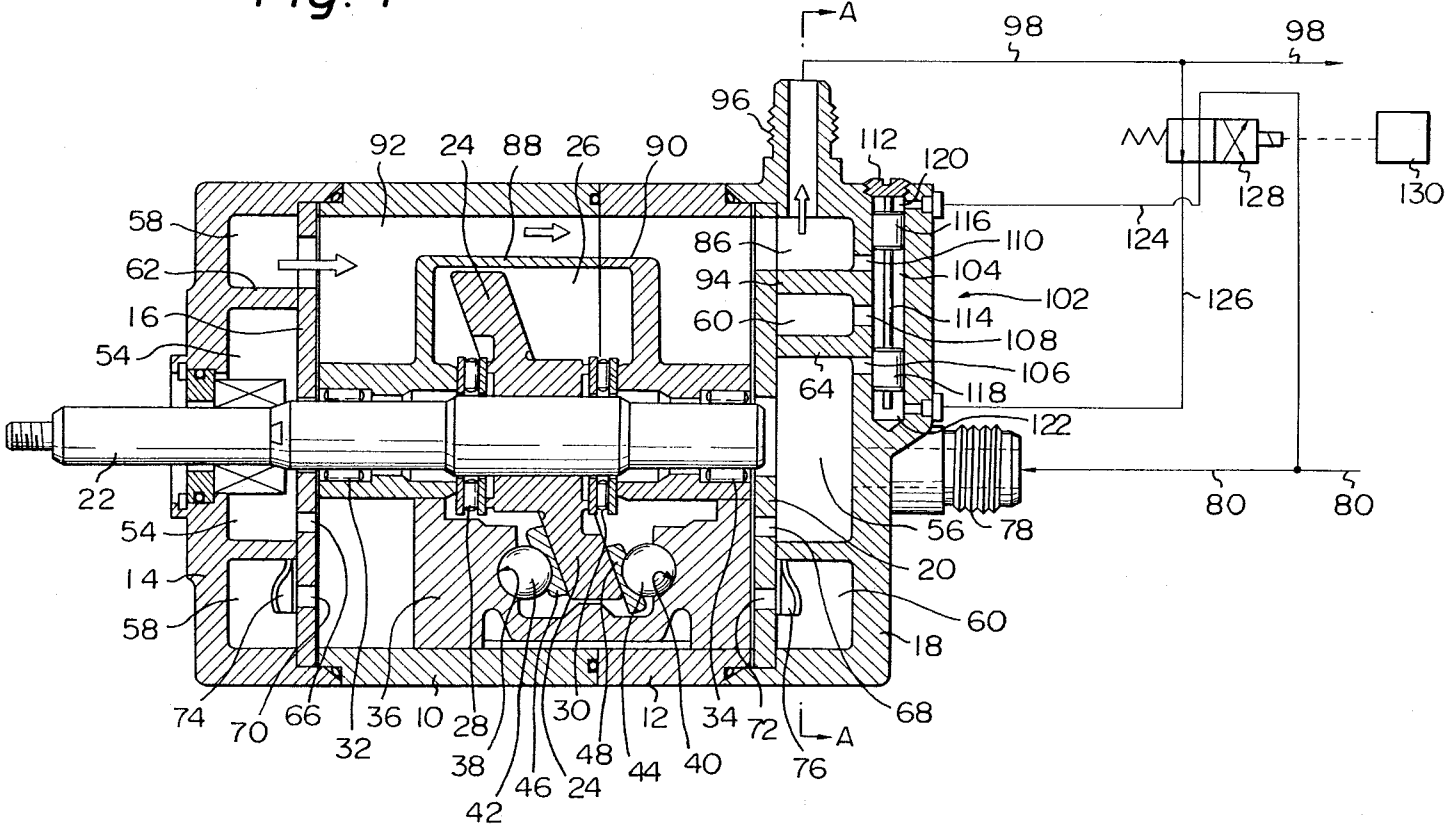
FIG. 1 is a sectional side view of a swash plate compressor equipped with a compression capacity control apparatus embodying the present invention.
Figure 2:
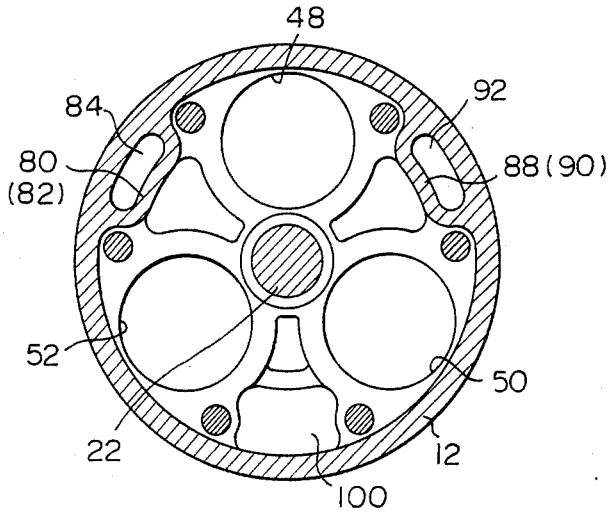
FIG. 2 is a sectional front view of the compression capacity control apparatus shown in FIG. 1.
Figure 3:
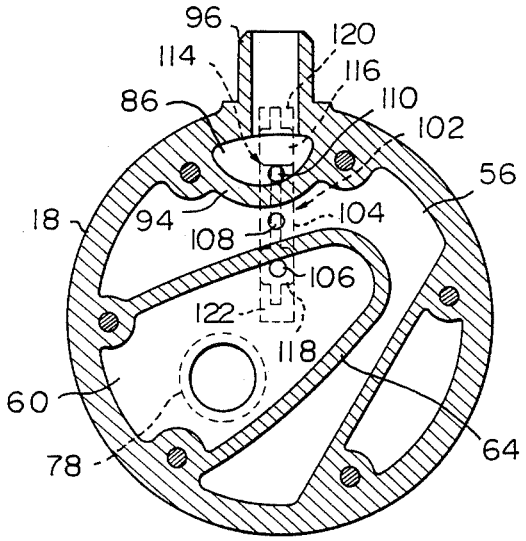
FIG. 3 is a section taken along line A—A of FIG. 1.

Referring to FIGS. 1-3, a swash plate compressor includes a pair of cylinder blocks 10 and 12 which are connected together at one end in a predetermined relative position. A front cover 14 is rigidly mounted to the other end of the cylinder block 10 with a cylinder head 16 held therebetween. Likewise, a rear cover 18 is rigidly mounted to the other end of the cylinder block 12 through a cylinder head 20. A drive shaft 22 extends along the axis of the aligned cylinder blocks 10 and 12 and protrudes from the front cover 14, as shown in FIG. 1. The drive shaft 22 is in driven connection with a drive source (not shown).

A swash plate 24 is mounted on the drive shaft 22 at an angle thereto and disposed in a crank case 26 which is defined by the cylinder blocks 10 and 12. The swash plate 24 and drive shaft 22 are rotatably supported by the cylinder blocks 10 and 12 through thrust bearings 28 and 30 and radial bearings 32 and 34.

A double acting piston 36 is bored at its axially central portion to straddle the peripheral edge of the swash plate 24. The opposite walls of the bore are formed with hemispherical ball pockets 38 and 40 in which balls 42 and 44 are received, respectively. The piston 36 hold the axially opposite ends of the swash plate 24 through the balls 42 and 44 and shoes 46 and 48, which are engaged with the respective balls 42 and 44. The cylinder blocks 10 and 12 are provided with cylinder bores which may be three in number as designated by the reference numerals 48, 50 and 52 in FIG. 2. The cylinder bores 48, 50 and 52 extend in parallel with the drive shaft 22 at equally spaced locations along the circumference of the cylinder blocks 10 and 12. The piston 36 is slidably received in each of the cylinder bores 48, 50 and 52. With this arrangement, when the swash plate 24 oscillates on the drive shaft 22 as the latter is driven for rotation, it causes each piston 36 into reciprocal movement within the corresponding cylinder bore through the associated shoes 46 and 48 and balls 42 and 44.

The cylinder bores 48, 50 and 52 are individually closed at the opposite ends by the cylinder heads 16 and 20 and communicated at an intermediate portion to the crank case 26.

Annular walls 62 and 64 are formed integrally with the front and rear covers 14 and 18, respectively. The annular wall 62 defines a low pressure chamber 54 thereinside and a high pressure chamber 58 thereoutside. Likewise, the annular wall 64 defines a low pressure chamber 56 and a high pressure chamber 60 on the opposite sides thereof. The low pressure chambers 54 and 56 are communicated with the cylinder bores 48, 50 and 52 through inlet openings 66 and 68 which are formed in the cylinder heads 16 and 20, respectively. The high pressure chambers 58 and 60, on the other hand, are communicated with the cylinder bores 48, 50 and 52 through outlet openings 70 and 72 which are formed in the cylinder heads 16 and 20, respectively. The inlet openings 66 and 68 and the outlet openings 70 and 72 are blocked by delivery valves 74 and 76 which are located on the axially outer ends of the respective cylinder heads 16 and 20.

A suction conduit 80 is communicated to the low pressure chamber 56 in the rear cover 18 through a coupling 78 which is fit in the rear cover 18. The low pressure chamber 56 is communicated to the low pressure chamber 54 in the front cover 14 by an inlet passageway 84 defined by openings which are formed through walls 80 and 82 (see FIG. 2) of the cylinder blocks 10 and 12 and the cylinder heads 16 and 20.

A delivery chamber 86 is formed in the rear cover 18. The delivery chamber 86 is communicated with the high pressure chamber 58 in the front cover 14 by an outlet passageway 92 defined by openings which are formed through walls of the cylinder blocks 10 and 12 and the cylinder heads 16 and 20. However, communication of the delivery chamber 86 with the high pressure chamber 60 in the rear cover 18 is prevented by a wall 94 which extends from the rear cover 18. A delivery conduit 98 is connected with the delivery chamber 86 through a coupling 96 fit in the rear cover 18.

Lubrication oil is stored in a reservoir 100 which is defined below the crank case 26 (see FIG. 2). The peripheral edge of the swash plate 24 is dipped in the lubricant.

A compression capacity control apparatus embodying the present invention is associated with the compressor described above and generally designated by the reference numeral 102. The control apparatus 102 functions to control intercommunication between the low pressure chamber 56, high pressure chamber 60 and delivery chamber 86 all of which are formed in the rear cover 18. In the illustrated embodiment, the rear cover 18 is formed with a vertical bore or capacity control passageway 104 and three openings 106, 108 and 110. A cap 112 closes the upper end of the capacity control passageway 104. The opening 106 communicates the low pressure chamber 56 to the passageway 104, the opening 108 communicates the high pressure chamber 60 to the passageway 104, and the opening 110 communicates the delivery chamber 86 to the passageway 104.

A valve member 114 is slidably received in the control passageway 104. The valve member 114 is in the form of a pilot pressure-operated valve spool formed with lands 116 and 118 at its opposite sides. The lands 116 and 118 define upper and lower pilot pressure chambers 120 and 122, respectively. When the pressure in the lower pilot pressure chamber 122 is higher than the pressure in the upper pilot pressure chamber 120, the valve spool 114 is urged to the position shown in FIG. 1 where it blocks the communication between the low pressure chamber 56 and the high pressure chamber 60 with the lower land 118 while communicating the high pressure chamber 60 to the delivery chamber 86. As the pressure in the upper pilot pressure chamber 120 rises beyond the pressure in the lower pilot pressure chamber 122, the valve spool 114 blocks the communication between the high pressure chamber 60 and the delivery chamber 86 with the upper land 116 while communicating the low pressure chamber 56 to the high pressure chamber 60.

Pilot conduits 124 and 126 are connected at one end to the pilot pressure chambers 120 and 122, respectively. The other end of each pilot conduit 124 or 126 is communicable to the suction conduit 80 or the delivery conduit 98 through a solenoid-operated directional control valve 128. A control circuit 130 supplies the directional control valve 128 with a control signal to switch it from one position to the other. When applied to an automotive air conditioning system, the control circuit 130 will produce control signals in response to various parameters such as engine speed, intake vacuum, pressure in the suction conduit 80 or the delivery conduit 98 and temperature inside or outside the passenger compartment.

Figure 4:
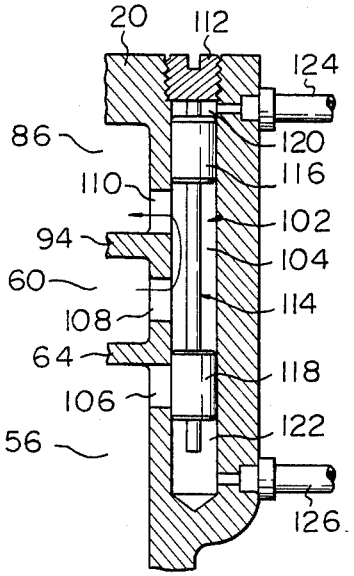
FIG. 4 is a fragmentary enlarged section of the apparatus in a full-capacity operation mode.

While the directional control valve 128 is in a normal position, the upper pilot pressure chamber 120 is supplied with the low pilot pressure from the suction conduit 80 and the lower pilot pressure chamber 122 with the high pilot pressure from the delivery conduit 98. Under this condition, the valve spool 114 is moved upwardly to communicate the high pressure chamber 60 to the delivery chamber 86 and discommunicate the low pressure chamber 56 from the high pressure chamber 60 (see FIG. 4). Thus, in either the front or rear cover, a gas sucked in the cylinder bore 48, 50, 52 through the low pressure chamber 54, 56 is compressed and communicated to the high pressure chamber 58, 60. The compressed gas from each cylinder bore is combined together in the delivery chamber 86. In this manner, all the cylinders are allowed to operate effectively in a full-capacity mode.

Figure 5:
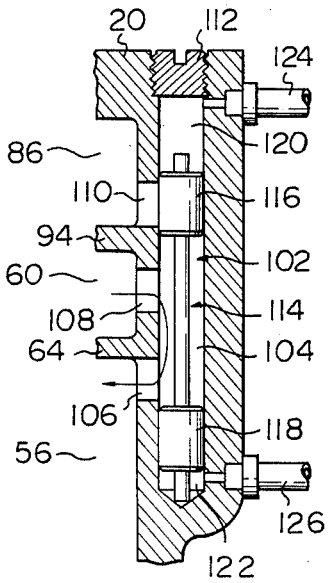
FIG. 5 is a view similar to FIG. 4 but showing the apparatus in a part-capacity operation mode.

When the control circuit 130 feeds a control signal to the directional control valve 128, the latter is switched to communicate the high pilot pressure from the delivery conduit 98 to the upper pilot pressure chamber 120 and the low pilot pressure from the suction conduit 80 to the lower pilot pressure chamber 122. Then, the valve spool 114 is caused to stroke downward so that, in the rear cover 18, the high pressure chamber 60 becomes discommunicated from the delivery chamber 86 while the low pressure chamber 56 is communicated to the high pressure chamber 60 (see FIG. 5). The compressed gas in the high pressure chamber 60 is now fed back to the low pressure chamber 56 via the control passageway 104. This makes only the cylinders on the front side effective thereby halving the total capacity of the compressor, i.e., establishes a part-capacity mode.

Figure 6:
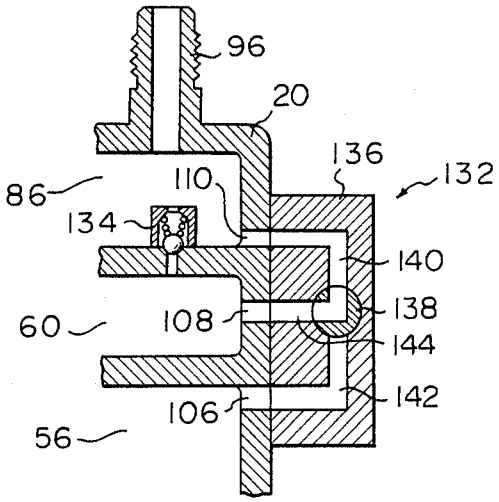
FIG. 6 is a fragmentary section of another embodiment of the present invention.

Referring to FIG. 6, another embodiment of the present invention is shown which differs from the first embodiment in the provision of a rotary three-way valve 132 for the capacity control apparatus 102 and a safety or relief valve 134. The valve 132 comprises a body 136 mounted on the rear cover 18 and a rotatable valve member 138. The body 138 is formed with three passageways 140, 142 and 144 while the rotary valve member 138 is positioned at the junction between the three passageways 140–144. The valve member is rotatable 90° to control the communication between the passageways 140–144. While the valve member 138 is moving from one position to another, the high pressure chamber 60 will become isolated from the others to have the pressure elevated therein. The relief valve 134 passes such an elevated pressure into the delivery chamber 86.

In each of the foregoing embodiments, the delivery chamber 86, control passageway 104 and valves 114 and 132, which form an essential part of the present invention, are commonly associated with the rear cover 18. It will be apparent, however, that they can be associated with the front cover 14 without affecting the effects.

In summary, it will be seen that the present invention provides a compression capacity control apparatus which permits a swash plate compressor to operate in a part-capacity mode with a minimum of power loss and without affecting the efficiency expected in a full-capacity mode. It will also be seen that the capacity control apparatus of the invention hardly involves the possibility of failure.

Various modifications will become possible for those skilled in the art after receiving the teachings of the present disclosure without departing from the scope thereof.

What is claimed is:

1. In a swash plate compressor having a cylinder block, front and rear covers mounted on the opposite ends of the cylinder block, each front and rear covers being formed with a low pressure chamber for temporarily storing an incoming gas, a high pressure chamber for temporarily storing an outgoing gas and a deliver conduit for delivering the outgoing gas, a compression capacity control apparatus comprising:

a delivery chamber formed in one of the front and rear covers to be communicated with the high pressure chamber in the other cover, the delivery chamber being isolated from the high pressure chamber in said one cover and being connected with the delivery conduit;

a compression capacity control passageway providing communication between the delivery chamber and the high pressure chamber in said one cover and communication between the high and low pressure chambers in said one cover;

valve means comprising a rotary valve member disposed in the control passageway and operable to block communication between the delivery chamber and the high pressure chamber of said one cover while unblocking the communication between the high pressure chamber and the lower pressure chamber of said one cover; and a relief valve for communicating to the delivery chamber an elevated pressure in the compression chamber of said one cover while the valve means shifts from one position to another.

2. A compression capacity control apparatus as claimed in claim 1, in which the rotary valve member comprises a rotary threeway valve having a rotary member which is rotatable 90°.

* * * * *